US005743224A

United States Patent [19]

Hosaka et al.

[11] Patent Number: 5,743,224

[45] Date of Patent: Apr. 28, 1998

[54] VALVE LIFTER SURFACE AND PROCESSING METHOD THEREOF

[75] Inventors: Noriomi Hosaka; Hirokazu Uehara; Akira Hidaka; Nobutaka Hayashi, all of Atsugi, Japan

[73] Assignee: Unisia Jecs Corporation, Atsugi, Japan

[21] Appl. No.: 676,949

[22] Filed: Jul. 8, 1996

Related U.S. Application Data

[63] Continuation-in-part of Ser. No. 305,370, Sep. 13, 1994, abandoned.

[30] Foreign Application Priority Data

Sep. 14, 1993 [JP] Japan ..... 5-228761

[51] Int. Cl.[6] ..... F01L 1/16

[52] U.S. Cl. ..... 123/90.51; 123/90.48; 74/569; 29/888.43

[58] Field of Search ..... 123/90.48, 90.51; 74/569; 29/888.43

[56] References Cited

U.S. PATENT DOCUMENTS

| | | | |
|---|---|---|---|
| 3,545,415 | 12/1970 | Mori | 123/90.51 |
| 4,829,950 | 5/1989 | Kanamaru et al. | 123/90.51 |
| 4,867,113 | 9/1989 | Pieprzak et al. | 123/90.49 |
| 4,873,150 | 10/1989 | Doi et al. | 123/90.51 |
| 4,876,996 | 10/1989 | Mayer et al. | 123/90.51 |
| 4,909,198 | 3/1990 | Shiraya et al. | 123/90.51 |
| 5,289,804 | 3/1994 | Mori | 123/90.51 |

FOREIGN PATENT DOCUMENTS

| | | | |
|---|---|---|---|
| 3239325 | 4/1984 | Germany | 123/90.51 |
| 4030987 | 4/1992 | Germany | 123/90.51 |
| 63-100204 | 5/1988 | Japan | 123/90.51 |
| 149304 | 6/1991 | Japan | 123/90.51 |
| 3-149304 | 6/1991 | Japan . | |

*Primary Examiner*—Weilun Lo
*Attorney, Agent, or Firm*—Foley & Lardner

[57] ABSTRACT

A valve lifter and processing method therefor include a valve lifter surface to be installed in a recess of a cylinder head of an internal combustion engine. The method includes a grinding step for beveling, or tapering, the circumferential end of a cylindrical wall portion of the valve lifter which slidingly contacts the recess. Excess material resulting from the beveling process is then removed for smoothing the beveled circumferential end. The smoothed surface is then coated with a hardening layer for abrasion protection and smoother operational movement. As a final step, the hardening layer may be polished for further enhancement of operating performance.

13 Claims, 3 Drawing Sheets

VALVE LIFTER SURFACE AND PROCESSING METHOD THEREOF

This application is a continuation-in-part of U.S. Ser. No. 08/305,370 filed Sep. 13, 1994, abandoned.

BACKGROUND OF THE INVENTION

1. Field of The Invention

The present invention relates generally to a processing method for a valve lifter surface. Specifically, the invention relates to a valve lifter surface in which a thickness of a hardening layer formed on a cylindrical wall portion of the valve lifter is increased in the vicinity of any beveled edges.

2. Description of the Related Art

Valve operation mechanisms for internal combustion engines generally comprise a rotational camshaft by which valve opening force is effected. A cup-shaped lifter portion is interposed between the cam and the valve stem effecting opening as a driving force is transmitted to the valve stem via a cup-shaped lifter portion. The valve lifter support portion is disposed in an insert recess (e.g., a bore) formed in the cylinder head of the engine such that the valve is freely slidable within the recess. A so-called 'pinpoint support' is utilized for mounting the valve stem. The valve is lifted according to the rotational moment of the cam corresponding to the valve lifter. During operation, continuous abrasion occurs between the side walls of the insert recess and the circumferential wall of the lifter support portion such that eventually an annular gap is formed therebetween and valve performance is degraded.

Japanese Patent Application (Unexamined) 3-149304 discloses a valve lifter arrangement in which the circumferential wall of the valve lifter is coated with a hardening layer formed of nickel, or the like. Upper and lower edges of the circumferential wall of the hardening layer are then beveled.

However, according to this process, during a grinding process for forming the beveled portions, a burr is formed at the annular borders of each bevel of the hardening layer, creating areas in proximate with the beveled edges at which the hardening layer is thinner. Friction applied to the hardening layer, especially at high valve pressures, can lead to thinning of the hardening layer, and thus the presence of such thinner portions of the hardening layer can lead to shorter duty life or degrade the advantages of the hardening layer.

Thus, it has been required to provide a valve lifter mechanism in which uniform thickness of a hardening layer may be established for assuring consistent operational performance.

SUMMARY OF THE INVENTION

It is therefore a principal object of the present invention to overcome the drawbacks of the related art.

It is a further object of the present invention to provide a valve lifter for an internal combustion engine in which a thickness of the hardening layer coated around the valve lifter is increased in the vicinity of any beveled edges.

In order to accomplish the aforementioned and other objects, a processing method for a valve lifter surface for a valve lifter mounted in a recess of a cylinder head of an internal combustion engine is provided, comprising the steps of: a grinding step for tapering an annular circumferential edge portion of a cylindrical wall portion of the valve lifter which is inserted into the recess so as to form a beveled edge at the circumferential edge portion; removing a burr or excess material at the borders of the beveled edge to as to smooth the edges thereof; and forming a hardening layer on the cylindrical wall portion of the valve lifter including the beveled edge.

According to another aspect of the invention, a valve lifter for operation in cooperation with a cam of an internal combustion engine is provided, comprising: a substantially cylindrical, cup shaped lifter body including a circumferential wall portion; a polished beveled edge provided on at least one of upper and lower edges of the cup shaped lifter body; and a protective plating layer of a predetermined thickness uniformly established over at least a portion of the valve lifter including the at least one beveled edge.

DETAILED DESCRIPTION OF THE PREFERRED EMBODIMENTS

Figure 1:
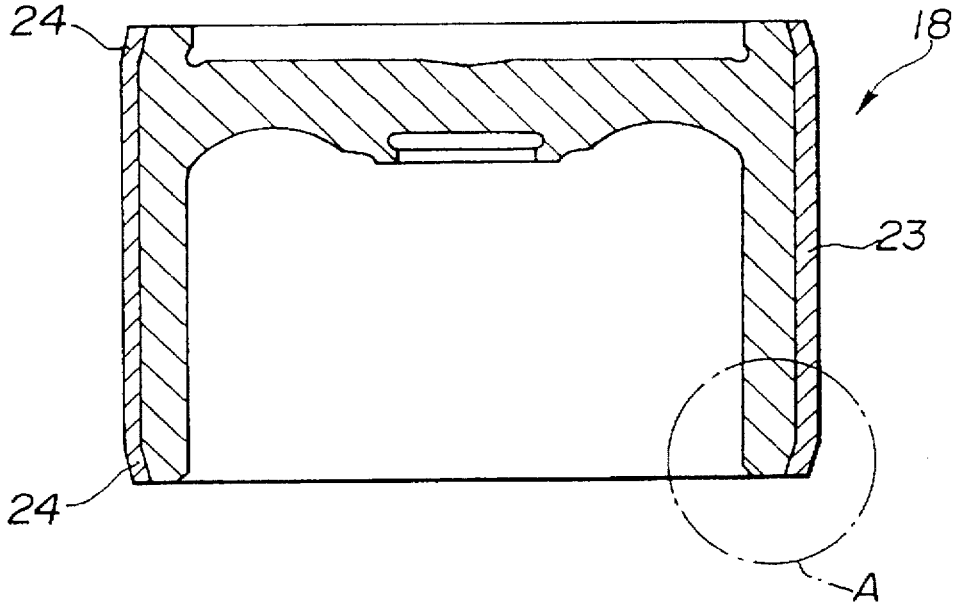
FIG. 1 is a schematic cross-sectional view of a valve lifter surface according to the invention.

Referring now to the drawings, a valve lifter surface processing method according to the invention will be explained hereinbelow in detail.

Figure 5:
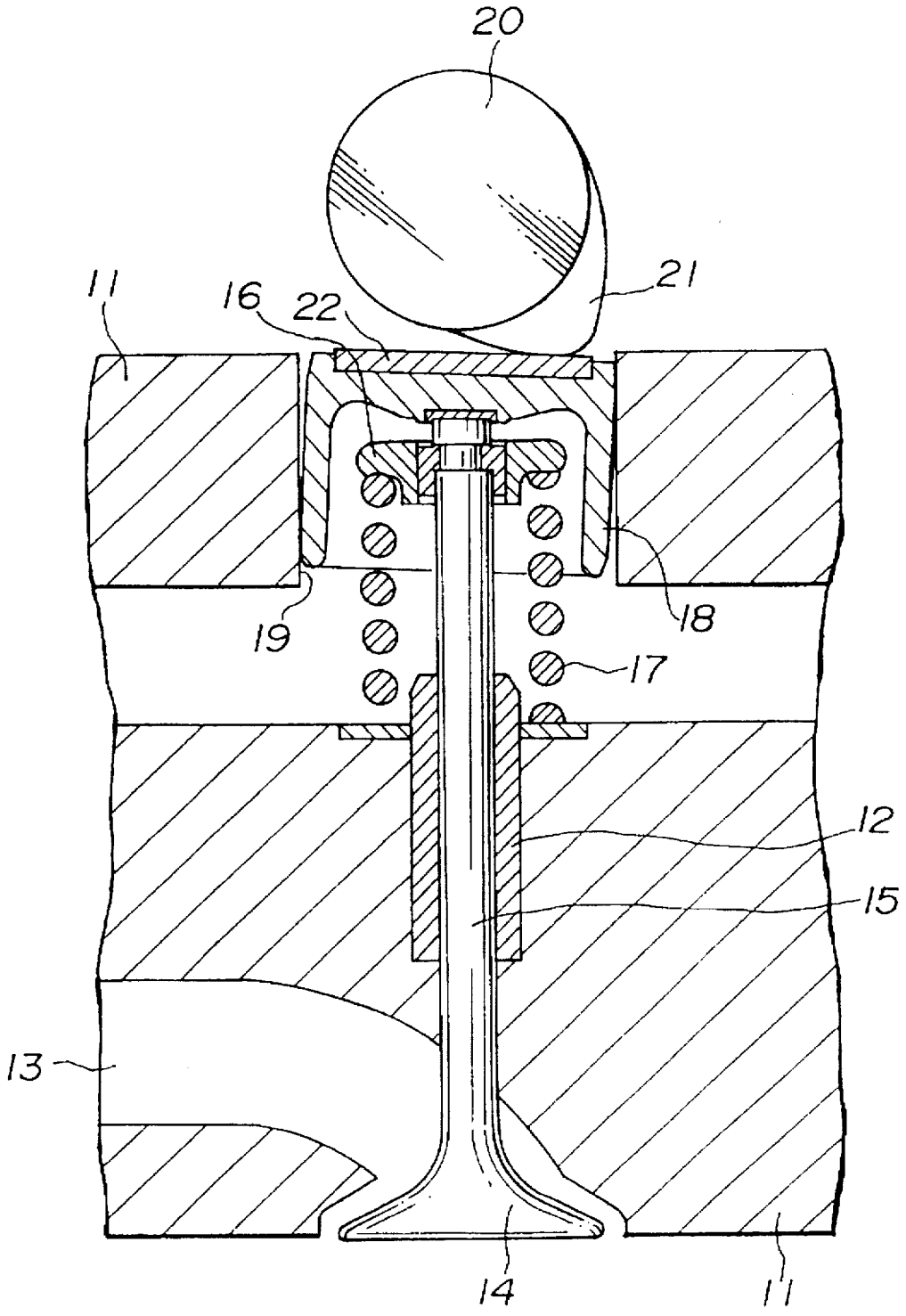
FIG. 5 is a cross-sectional view of a first embodiment of a valve lifter processed according to the invention installed in an internal combustion engine.

Referring to FIG. 5, a valve lifter mechanism comprises cylinder block 11 having a valve guide portion 12 formed integrally therewith. The cylinder block 11 further accommodates an exhaust port 13 which may be opened and closed according to reciprocal movement of a valve stem 15 which displaces an exhaust valve 14. The base of the valve stem 15 is mounted in spring seat 16, and a coil spring 17 is disposed between the spring seat 16 and a portion of the cylinder head 11 for providing a spring force for reciprocating the valve stem 15. A cup shaped valve lifter 18 is disposed between the spring seat 16 and a cam 21 for receiving rotational force transmitted therefrom. The valve lifter 18 is arranged to slide within a valve lifter recess 19 formed in the cylinder block 11 such that the valve lifter 18 is controlled to slide in the axial direction of the valve stem 15. The valve lifter 18 may be additionally provided with a shim 22 at the contact surface thereof for receiving direct contact of the cam 21 formed on a camshaft 20 of an internal combustion engine (not shown).

According to the present embodiment, as seen in FIG. 1, an outer cylindrical wall of the valve lifter 18 is plated with a hardening layer 23. According to the present invention, the valve lifter 18 has upper and lower circumferential edges thereof beveled to form upper and lower annular beveled edge portions 24, 24. Thus, when the outer cylindrical wall of the valve lifter 18 is plated with the hardening layer 23, the beveled edges 24, 24 are of a smaller circumference than the cylindrical diameter of the hardening layer 23, thus facilitating easier movement within the valve lifter recess 19.

Figure 2:
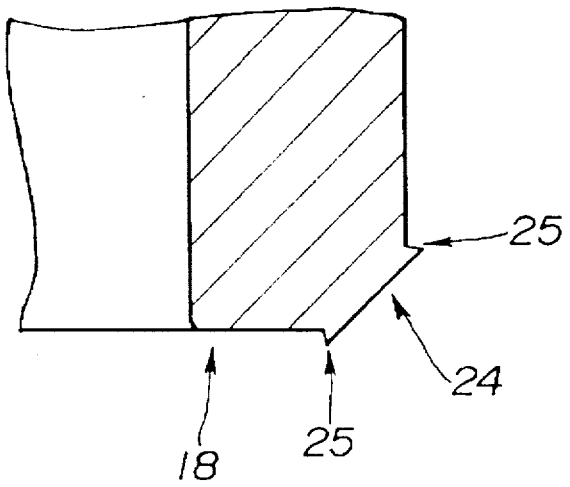
FIG. 2 is a cross sectional view of a detail of an unprocessed surface portion of the valve lifter of the invention in a location indicated by the arrow A of FIG. 1.

Referring now to FIG. 2, it may be seen that during grinding, or other processing for forming the beveled edges 24, 24, a burr 25 is formed at each of the upper and lower borders of the beveled edge 24. As noted hereinabove, the presence of such a burr 25 creates discontinuity in the thickness of the hardening layer 23.

Figure 3:
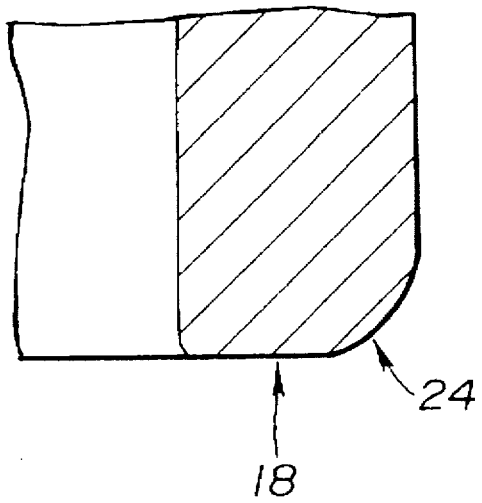
FIG. 3 is a cross-sectional view of the same surface portion of the valve lifter of FIG. 1 after surface processing.

Thus, according to the invention, a polishing step is utilized following the grinding of the beveled edge 24 for removing the burr 25 and generally smoothing the contours of the valve lifter 18, with a resulting surface as is shown in FIG. 3.

Figure 4:
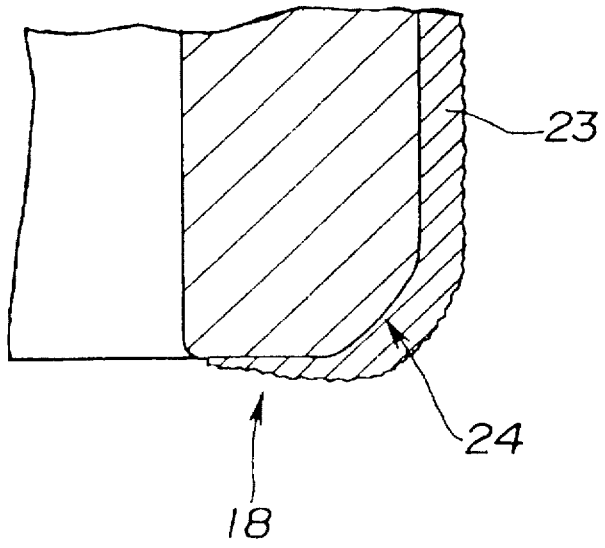
FIG. 4 is a detailed cross-sectional view of the processed surface portion of FIG. 2 after application of a hardening layer.

Subsequently, as seen in FIG. 4, the hardening layer 23 may be applied. As may be seen in the drawing, the thickness of the hardening layer 23 may be controlled consistently over the entire surface of the valve lifter 18 with no areas of anomalous thickness due to the presence of burr 25 or other unwanted particles which may adhere to the surface of the valve lifter 18 during processing. Accordingly, it is also possible to increase the thickness of the hardening layer 23 in the vicinity of the beveled edges 24 for increased protection of the edges of the valve lifter 18.

Thus, smooth valve operation may be reliably assured and frictional abrasion between the valve lifter 18 and the valve lifter recess 19 may be minimized.

To further enhance operational performance, an outer surface of the hardening layer 23 may be polished for further reducing friction.

It will be noted that the hardening layer may be formed of nickel or other coating of having suitable properties for forming the hardening layer. In addition, though the preferred embodiment is applied to an exhaust valve of an internal combustion engine, the method of the invention may favorably improve other types of valve arrangements. It will be noted that the advantages of the invention may be obtained if beveling is applied to both or to only one of the circumferential edges of the valve lifter.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A processing method for a valve lifter surface on a valve lifter mounted in a bore of a cylinder head of an internal combustion engine, comprising the steps of:

tapering an annular circumferential edge portion of a cylindrical wall portion of said valve lifter so as to form a beveled edge at said circumferential edge portion;

thereafter, removing a burr or excess material at said beveled edge to smooth said beveled edge; and thereafter, forming a hardening layer on said cylindrical wall portion of said valve lifter including said beveled edge, wherein a thickness of said hardening layer is increased in the vicinity of said beveled edge.

2. A processing method as set forth in claim 1, wherein said hardening layer is formed of nickel.

3. A processing method as set forth in claim 1, wherein a contact surface of said valve lifter is abutted by a shim.

4. A processing method as set forth in claim 1, wherein said valve lifter actuates an exhaust valve.

5. A processing method as set forth in claim 1, wherein, after the formation of the beveled edge but prior to the formation of the hardening layer, a first circumferential size of the cylindrical wall portion around the edge portion of the valve lifter is smaller than a second circumferential edge of the cylindrical wall portion around a remaining region of the valve lifter, and wherein, after the formation of the hardening layer on both the edge portion and the remaining region, a third circumferential size of the cylindrical wall portion around the hardened edge portion is smaller than a fourth circumferential edge of the cylindrical wall portion around the hardened remaining region.

6. A processing method as set forth in claim 1, further including a step of polishing an outer surface of said hardening layer.

7. A valve lifter for operation in cooperation with a cam of an internal combustion engine, comprising:

a substantially cylindrical, cup shaped lifter body including a circumferential wall portion;

a polished beveled edge provided on at least one of upper and lower edges of said cup shaped lifter body; and a protective placing layer of a predetermined thickness uniformly established over at least a portion of said valve lifter inducing said at least one polished beveled edge, wherein a thickness of said hardening layer is increased in the vicinity of said at least one polished beveled edge.

8. A valve lifter as set forth in claim 7, wherein said hardening layer is formed of nickel.

9. A valve lifter as set forth in claim 7, wherein a contact surface of said valve lifter is abutted by a shim.

10. A valve lifter as set forth in claim 7, wherein said valve lifter is operatively associated with an exhaust valve of said internal combustion engine.

11. A valve lifter as set forth in claim 7, wherein a circumference of the cup shaped lifter body including the polished beveled edge is smaller than a circumference of all other regions of the cup shaped lifter body.

12. A valve lifter as set forth in claim 7, wherein said hardening layer includes an outer surface polished so as to increase a surface smoothness thereof.

13. A valve lifter as set forth in claim 7, wherein a circumference of the cup shaped lifter body including the polished beveled edge is smaller than a circumference of all other regions of the cup shaped lifter body.

* * * * *